US011946129B2

(12) United States Patent
Shutoh et al.

(10) Patent No.: US 11,946,129 B2
(45) Date of Patent: Apr. 2, 2024

(54) Cu—Ni—Al BASED COPPER ALLOY SHEET MATERIAL, METHOD FOR PRODUCING SAME, AND CONDUCTIVE SPRING MEMBER

(71) Applicant: DOWA METALTECH CO., LTD., Tokyo (JP)

(72) Inventors: Toshiya Shutoh, Tokyo (JP); Hisashi Suda, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 377 days.

(21) Appl. No.: 17/270,132

(22) PCT Filed: Aug. 20, 2019

(86) PCT No.: PCT/JP2019/032505

§ 371 (c)(1),
(2) Date: Feb. 22, 2021

(87) PCT Pub. No.: WO2020/066371

PCT Pub. Date: Apr. 2, 2020

(65) Prior Publication Data

US 2021/0238724 A1 Aug. 5, 2021

(30) Foreign Application Priority Data

Sep. 27, 2018 (JP) ..... 2018-182691

(51) Int. Cl.
*C22F 1/08* (2006.01)
*C22C 9/06* (2006.01)

(52) U.S. Cl.
CPC ..... *C22F 1/08* (2013.01); *C22C 9/06* (2013.01)

(58) Field of Classification Search
CPC ..... C22F 1/08; C22C 9/06; C21D 8/0226; C21D 8/0236; C21D 9/46
See application file for complete search history.

(56) References Cited

U.S. PATENT DOCUMENTS

2013/0333812 A1* 12/2013 Ishida ..... C22C 9/06 148/414

FOREIGN PATENT DOCUMENTS

| | | |
|---|---|---|
| CN | 103509970 | 1/2014 |
| JP | 52-095531 | 8/1977 |

(Continued)

*Primary Examiner* — John A Hevey
(74) *Attorney, Agent, or Firm* — Clark & Brody LP

(57) ABSTRACT

To provide, as a sheet material of a Cu—Ni—Al based copper alloy having a compositional range exhibiting a whitish metallic appearance that is excellent in "strength-bending workability balance" and is excellent in discoloration resistance, a copper alloy sheet material having a composition containing, in terms of % by mass, Ni: more than 12.0% and 30.0% or less, Al: 1.80-6.50%, Mg: 0-0.30%, Cr: 0-0.20%, Co: 0-0.30%, P: 0-0.10%, B: 0-0.05%, Mn: 0-0.20%, Sn: 0-0.40%, Ti: 0-0.50%, Zr: 0-0.20%, Si: 0-0.50%, Fe: 0-0.30%, and Zn: 0-1.00%, with the balance of Cu and unavoidable impurities, and satisfying Ni/Al≤15.0, and having a metallic structure having, on an observation plane in parallel to a sheet surface (rolled surface), a number density of fine secondary phase particles having a particle diameter of 20 to 100 nm of $1.0\times10^7$ per $mm^2$ or more.

7 Claims, 1 Drawing Sheet

(56) References Cited

FOREIGN PATENT DOCUMENTS

| | | | | |
|---|---|---|---|---|
| JP | 1-149946 | | 6/1989 | |
| JP | 5-320790 | | 12/1993 | |
| JP | 6-128708 | | 5/1994 | |
| JP | 2019-002042 | | 1/2019 | |
| WO | 2012/081573 | | 6/2012 | |
| WO | WO-2012081573 | A1 * | 6/2012 | ..... C22C 9/01 |

* cited by examiner

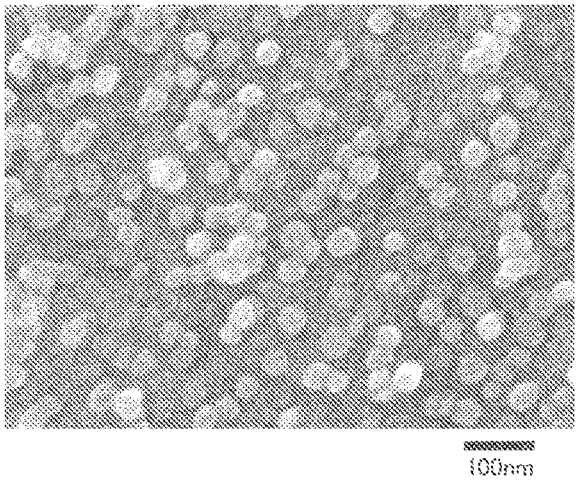
100nm

Cu—Ni—Al BASED COPPER ALLOY SHEET MATERIAL, METHOD FOR PRODUCING SAME, AND CONDUCTIVE SPRING MEMBER

TECHNICAL FIELD

The present invention relates to a Cu—Ni—Al based copper alloy sheet material and a method for producing the same, and a conductive spring member using the sheet material.

BACKGROUND ART

A Cu—Ni—Al based copper alloy can have a strength enhanced with a Ni—Al based precipitate, and exhibits a metallic appearance with less copper-like color among copper alloys. This copper alloy is useful as a conductive spring member, such as a lead frame and a connector, and a non-magnetic high strength member.

A conductive spring member, such as a connector, is generally produced through a working process including bending work. Accordingly, a copper alloy sheet material as a material for providing a conductive spring member having a high capability and a high dimensional accuracy is demanded to have high strength and excellent bending workability, i.e., an excellent "strength-bending workability balance". A Cu—Ni—Al based copper alloy becomes to exhibit a white metallic appearance with the increase of the content of Ni, which is effective for the enhancement of the strength. A Cu—Ni—Al based copper alloy may also undergo discoloration under exposure to a high humidity environment as similar to other ordinary copper alloys, and for the purpose where a whitish surface appearance is important, it is important to have excellent discoloration resistance for preventing the beautiful white color from being impaired.

Various investigations have been made for improving the characteristics (such as conductivity, workability, fatigue characteristics, and stress relaxation characteristics) of a Cu—Ni—Al based copper alloy while exploiting the high strength characteristics thereof.

For example, PLT 1 describes a technique of providing a material excellent in high strength, workability, and high conductivity by subjecting a Cu—Ni—Al based copper alloy containing a prescribed amount of Si to a solution treatment at 700 to 1,020° C. and an aging treatment at 400 to 650° C., so as to deposit a y' phase containing Si with an average particle diameter of 100 nm or less. However, the literature describes about the workability thereof that "the cold workability, in the case of rolling performed at a temperature of 20° C., is defined by the maximum thickness reduction ratio that can be obtained by rolling without annealing and occurrence of cracks" (paragraph 0017), and there is no description about a measure for improving the bending workability. The deformation behaviors are different between bending work and cold rolling. It is difficult to improve the bending workability by the aforementioned process. Furthermore, there is no description about the improvement of the discoloration resistance.

PTL 2 describes a technique of enhancing the characteristics, such as strength and bending workability, of a Cu—Ni—Al based copper alloy by subjecting to a solution treatment at 820 to 920° C., an aging treatment at 400 to 600° C., and tension annealing at 380 to 700° C., so as to make the Ni—Al based intermetallic compound as a fine precipitated structure. However, the target alloy has a low Ni content of 6 to 12% by mass. There is no teaching about a measure for achieving both the excellent strength-bending workability balance and the discoloration resistance in the compositional range exhibiting a whitish appearance with a Ni content higher than the aforementioned range.

PTL 3 describes a technique of providing a sheet material having good strength and bending workability by subjecting a Cu—Ni—Al based copper alloy to a process including a solution treatment at 700° C. or more, an aging treatment at 200 to 400° C., cold rolling of 10% or more, and a heat treatment at 300 to 600° C. However, according to the investigation by the present inventors, the alloy specifically described in the literature has a low Ni content and is insufficient in discoloration resistance. Furthermore, in the case where the contents of Ni and Al of the alloy composition are sufficiently increased to secure the discoloration resistance, it is difficult to improve the bending workability by the production process described in the literature.

PTL 4 describes a technique of providing a sheet material excellent in strength, elasticity, electroconductivity, formability, and stress relaxation resistance characteristics by subjecting a Cu—Ni—Al based copper alloy to a process including a solution treatment at 750 to 950° C., an aging treatment at 300 to 550° C. depending on necessity, cold rolling of 30 to 90%, and an aging treatment at 300 to 600° C. However, a strength level with a tensile strength of 900 MPa or more, or further 1,000 MPa or more, cannot be achieved by the technique. Furthermore, PTL 4 does not describe about a measure for improving the discoloration resistance.

CITATION LIST

Patent Literatures

PTL 1: WO 2012/081573
PTL 2: JP-A-6-128708
PTL 3: JP-A-1-149946
PTL 4: JP-A-5-320790

SUMMARY OF INVENTION

Technical Problem

Associated with the reduction in size of a conductive spring member, such as a connector, in recent years, a sheet material as a material therefor is increasingly demanded to have a reduced thickness, and the enhancement of the strength of the material is becoming important more than ever. A connector and the like are generally produced through bending work. In general, the strength and the bending workability are characteristics that are conflict with each other, but for addressing the recent needs of reduction in size, it is necessary that the good bending workability is retained while achieving the high strength. The securement of the sufficient bending workability is not necessarily easy in a copper alloy sheet material that has enhanced strength.

A Cu—Ni—Al based copper alloy having a compositional range with a relatively high Ni content (approximately 10% by mass or more) exhibits a whitish metallic appearance as described above, and thus is useful due to the advantage thereof that in a purpose demanding such a color tone, for example, an ordinary iron based material can be replaced by the copper alloy having high conductivity. However, the discoloration resistance thereof under the use environment becomes important since the alloy exhibits a whitish metallic appearance. It is the current situation that a measure for achieving both high strength and bending workability within the compositional range providing good discoloration resistance has not yet been established.

An object of the present invention is to provide a sheet material of a Cu—Ni—Al based copper alloy having a compositional range exhibiting a whitish metallic appearance that is excellent in "strength-bending workability balance" and is excellent in discoloration resistance.

Solution to Problem

The studies made by the present inventors have revealed the following.

(a) For enhancing the discoloration resistance of a Cu—Ni—Al based copper alloy having a compositional range exhibiting a whitish metallic appearance (for example, a composition having a Ni content exceeding 12.0% by mass), it is necessary to increase an Al content corresponding to the increase of the Ni content.

(b) For improving the bending workability of the Cu—Ni—Al based copper alloy having a composition having a high Ni content and also a relatively high Al content, it is significantly effective to make a metallic structure having a large existing amount of "fine secondary phase particles" having a particle diameter of 20 to 100 nm.

(c) The "fine secondary phase particles" also contribute to the enhancement of the strength. Accordingly, the structure state with a sufficiently large existing amount of the "fine secondary phase particles" is important for achieving the excellent "strength-bending workability balance".

(d) The structure state with a sufficiently large existing amount of the "fine secondary phase particles" can be obtained by subjecting, after the solution treatment, to a first aging treatment at a high temperature for a short period of time at 670 to 900° C. retaining for 10 to 300 seconds, a second aging treatment at a low temperature for a long period of time at 400 to 620° C. retaining for 0.5 to 75 hours.

The present invention has been completed based on the knowledge.

The following inventions are shown in the description herein.

[1] A Copper Alloy Sheet Material having a composition containing, in terms of % by mass, Ni: more than 12.0% and 30.0% or less, Al: 1.80-6.50%, Mg: 0-0.30%, Cr: 0-0.20%, Co: 0-0.30%, P: 0-0.10%, B: 0-0.05%, Mn: 0-0.20%, Sn: 0-0.40%, Ti: 0-0.50%, Zr: 0-0.20%, Si: 0-0.50%, Fe: 0-0.30%, and Zn: 0-1.00%, with the balance of Cu and unavoidable impurities, and satisfying the following expression (1), and having a metallic structure having, on an observation plane in parallel to a sheet surface (rolled surface), a number density of fine secondary phase particles having a particle diameter D m defined by the following (A) of 20 to 100 nm of 1.0×10 7 per $mm^2$ or more:

$$Ni/Al \leq 15.0 \quad (1)$$

wherein in the expression (1), the atomic symbols are substituted by the contents of the elements expressed with % by mass, (A) assuming that for one secondary phase particle, a diameter (nm) of a minimum circle surrounding the particle is referred to as a "major diameter", and a diameter (nm) of a maximum circle encompassed in a contour of the particle is referred to as a "minor diameter", a value shown by (major diameter+minor diameter)/2 is designated as the particle diameter $D_M$ of the particle.

[2] The copper alloy sheet material according to the item [1], wherein an average crystal particle diameter in a sheet thickness direction defined by the following (B) is 50.0 μm or less, (B) a straight line is randomly drawn in the sheet thickness direction on an optical micrograph obtained through observation of a cross section (C cross section) perpendicular to a rolling direction, and an average cut length of crystal particles cut by the straight line is designated as the average crystal particle diameter in the sheet thickness direction, provided that on one or plural observation view fields, plural straight lines that do not redundantly cut the same crystal particle are randomly set, and the total number of crystal particles that are cut by the plural straight lines is 100 or more.

[3] The copper alloy sheet material according to the item [1] or [2], wherein, on an observation plane in parallel to a sheet surface (rolled surface), a number density of coarse secondary phase particles having a major diameter is 5.0 μm or more of $5.0\times10^3$ per $mm^2$ or less.

[4] The copper alloy sheet material according to any one of the items [1] to [3], wherein the copper alloy sheet material has a tensile strength in the rolling direction of 900 MPa or more.

[5] A method for producing a copper alloy sheet material, including:

a step of heating a cast piece having a composition containing, in terms of % by mass, Ni: more than 12.0% and 30.0% or less, Al: 1.80-6.50%, Mg: 0-0.30%, Cr: 0-0.20%, Co: 0-0.30%, P: 0-0.10%, B: 0-0.05%, Mn: 0-0.20%, Sn: 0-0.40%, Ti: 0-0.50%, Zr: 0-0.20%, Si: 0-0.50%, Fe: 0-0.30%, and Zn: 0-1.00%, with the balance of Cu and unavoidable impurities, and satisfying the following expression (1), to 1,000 to 1,150° C. (cast piece heating step);

a step of subjecting to hot rolling under a condition providing a rolling reduction ratio at 950° C. or more of 65% or more and a rolling temperature in a final pass of 800° C. or more (hot rolling step);

a step of subjecting to cold rolling at a rolling reduction ratio of 80% or more (cold rolling step);

a step of subjecting to a heat treatment at 950 to 1,100° C. retaining for 30 to 360 seconds (solution treatment step);

a step of subjecting to cold rolling in a range of a rolling reduction ratio of 50% or less (finish cold rolling step);

a step of subjecting to a heat treatment at 670 to 900° C. retaining for 10 to 300 seconds (first aging treatment Step); and a step of subjecting to a heat treatment at 400 to 620° C. retaining for 0.5 to 75 hours (second aging treatment step), performed in this order, so as to provide a metallic structure having, on an observation plane in parallel to a sheet surface (rolled surface), a number density of fine secondary phase particles having a particle diameter $D_M$ defined by the following (A) of 20 to 100 nm of $1.0\times10^7$ per $mm^2$ or more:

$$Ni/Al \leq 15.0 \quad (1)$$

wherein in the expression (1), the atomic symbols are substituted by the contents of the elements expressed with % by mass, (A) assuming that for one secondary phase particle, a diameter (nm) of a minimum circle surrounding the particle is referred to as a "major diameter", and a diameter (nm) of a maximum circle encompassed in a contour of the particle is referred to as a "minor diameter", a value shown by (major diameter+minor diameter)/2 is designated as the particle diameter $D_M$ of the particle.

[6] A method for producing a copper alloy sheet material including the production method according to the item [5], provided that the finish cold rolling step is not performed, and a material obtained by the solution treatment is subjected to the first aging treatment.

[7] A conductive spring member including the copper alloy sheet material according to any one of the items [1] to [4] as a material.

[Method for obtaining Number Density of Fine Secondary Phase Particles]

The sheet surface (rolled surface) is electrochemically polished under the following condition to produce an observation plane.

Electrolytic solution: Phosphoric acid aqueous solution having 40% by mass of phosphoric acid and 60% by mass of pure water Liquid temperature: 20° C.

Voltage: 20 V

Electrolysis time: 15 seconds

On the resulting observation plane, 10 or more view fields that do not overlap each other randomly selected are observed with an FE-SEM (field emission scanning electron microscope) at a magnification of 150,000, the number of secondary phase particles having a particle diameter $D_M$ according to the aforementioned (A) of 20 to 100 nm among the particles having an entire contour that is visible is counted on the observation images of the view fields, and a value obtained by dividing the total of the counted numbers $N_{TOTAL}$ in all the observed view fields by the total area of the observation view fields is converted to a number per 1 $mm^2$ and designated as the number density (per $mm^2$) of the fine secondary phase particles. [Method for obtaining Number Density of Coarse Secondary Phase Particles]

The sheet surface (rolled surface) is electrochemically polished to dissolve only the Cu matrix, so as to prepare an observation plane having the secondary phase particles exposed, the observation plane is observed with an SEM (scanning electron microscope), and a value obtained by dividing the total number of the secondary phase particles having a major diameter of 5.0 μm or more observed on the SEM image by the total observation area ($mm^2$) is designated as the number density (per $mm^2$) of the coarse secondary phase particles. The total observation area is 0.1 $mm^2$ or more in total of plural observation view fields randomly set that do not overlap each other. The secondary phase particle that is partially deviated from the observation view field is counted in the case where the major diameter of the part thereof appearing inside the observation field is 5.0 μm or more.

The rolling reduction ratio of from a thickness to (mm) to a thickness $t_1$ (mm) is obtained by the following expression (2).

$$\text{Rolling reduction ratio (\%)}=(t_0-t_1)/t_0\times 100 \quad (2)$$

Advantageous Effects of Invention

According to the present invention, a sheet material of a Cu—Ni—Al based copper alloy having a compositional range exhibiting a whitish metallic appearance that is excellent in "strength-bending workability balance" and is excellent in discoloration resistance can be provided.

BRIEF DESCRIPTION OF DRAWING

The sole FIGURE is the FE-SEM (field emission scanning electron microscope) micrograph obtained by observing the fine secondary phase particles of the sheet material obtained in Example 1 at a magnification of 150,000.

DESCRIPTION OF EMBODIMENTS

[Chemical Composition]

The present invention targets a Cu—Ni—Al based copper alloy. In the following description, the "%" relating to the alloy components means "% by mass" unless otherwise indicated.

Ni is a major element that constitutes the matrix (metal matrix) of the Cu—Ni—Al based copper alloy along with Cu. A part of Ni in the alloy is bonded to Al to form particles of a secondary phase (i.e., a Ni—Al based precipitated phase) to contribute to the enhancement of the strength and the bending workability. A Cu—Ni—Al based copper alloy becomes to exhibit a whitish metallic appearance with the increase of the Ni content as compared to other ordinary copper alloys. However, a thin oxide film is formed on the metal surface under exposure to a high humidity environment, as similar to other copper alloys, and the alloy may undergo discoloration to such an extent that can be recognized from the appearance in some cases. In this case, the beautiful white appearance thereof is impaired. According to the investigations by the present inventors, it has been found that in the case where the discoloration resistance is particularly important, it is significantly effective to increase the Ni content to larger than 12.0%, and to secure the Al content as described later. Accordingly, the present invention targets a Cu—Ni—Al based copper alloy having a Ni content exceeding 12.0%. It is more effective that the Ni content is 15.0% or more. On the other hand, the increase of the Ni content may deteriorate the hot workability. The Ni content is limited to 30.0% or less, and may be managed to 25.0% or less. The Ni content may be 18.0% or more and 22.0% or less.

Al is an element that forms a Ni—Al based precipitate. With a too small Al content, the enhancement of the strength may be insufficient. The discoloration resistance can be improved by increasing the Al content along with the increase of the Ni content. As a result of the various investigations, it is necessary that the Al content is 1.80% or more, and Al is contained to satisfy the following expression (1). The following expression (1)' is more preferably satisfied.

$$Ni/Al\leq 15.00 \quad (1)$$

$$Ni/Al\leq 11.00 \quad (1)$$

In the expressions (1) and (1)', the atomic symbols are substituted by the contents of the elements expressed with % by mass.

On the other hand, an excessive Al content may deteriorate the hot workability. The Al content is limited to 6.50% or less.

As additional elements, Mg, Cr, Co, P, B, Mn, Sn, Ti, Zr, Si, Fe, Zn, and the like may be contained depending on necessity. The content ranges of these elements are Mg: 0-0.30%, Cr: 0-0.20%, Co: 0-0.30%, P: 0-0.10%, B: 0-0.05%, Mn: 0-0.20%, Sn: 0-0.40%, Ti: 0-0.50%, Zr:

0-0.20%, Si: 0-0.50%, Fe: 0-0.30%, and Zn: 0-1.00%. The total amount of the optionally added elements is preferably 2.0% or less, and more preferably 1.0% or less.

[Number Density of Fine Secondary Phase Particles]

In the description herein, secondary phase particles having a particle diameter D m according to the following (A) of 20 to 100 nm are referred to as "fine secondary phase particles". Secondary phase particles that have a smaller particle diameter than the fine secondary phase particles may be referred to as "ultrafine secondary phase particles" in some cases.

(A) Assuming that for one secondary phase particle, a diameter (nm) of a minimum circle surrounding the particle is referred to as a "major diameter", and a diameter (nm) of a maximum circle encompassed in a contour of the particle is referred to as a "minor diameter", a value shown by (major diameter+minor diameter)/2 is designated as the particle diameter D M of the particle.

The fine secondary phase particles are a Ni—Al based precipitate phase constituted mainly by $Ni_3Al$. According to the investigations by the present inventors, it has been found that for enhancing the bending workability of a Cu—Ni—Al based copper alloy having a compositional range that has a high Ni content and is excellent in discoloration resistance, it is significantly effective to increase the existing amount of the "fine secondary phase particles". While the mechanism therefor is unclear at present, as a result of the detailed experiment, the bending workability of the Cu—Ni—Al based copper alloy sheet material having the aforementioned compositional range can be stably enhanced by making a metal structure having a number density of the fine secondary phase particles having a particle diameter $D_M$ according to the (A) of 20 to 100 nm of $1.0\times10^7$ per $mm^2$ or more.

It is considered that the enhancement of the strength of the Cu—Ni—Al based copper alloy is contributed by both the "fine secondary phase particles" and the "ultrafine secondary phase particles" having a smaller particle diameter. According to the investigations by the present inventors, however, it has been found that in the case where the metal structure has an existing amount of the "fine secondary phase particles" that is increased to such an extent that can sufficiently provide the improvement effect of the bending workability, the strength level is also necessarily increased sufficiently. Accordingly, the structure state having a number density of the fine secondary phase particles of $1.0\times10^7$ per $mm^2$ or more can achieve the excellent "strength-bending workability balance", specifically can achieve both high tensile strength in the rolling direction of 900 MPa or more, and further 1,000 MPa or more, and bending workability with a ratio MBR/t of the minimum bending radius MBR that does not cause cracking in a 90° W-bending test and the sheet thickness t of 1.5 or less. The number density of the fine secondary phase particles is more preferably $2.0\times10^7$ per $mm^2$ or more. The upper limit of the number density thereof is not particularly necessarily determined, and may be controlled, for example, to a range of $40.0\times10^7$ per $mm^2$ or less.

[Number Density of Coarse Secondary Phase Particles]

In the description herein, secondary phase particles having a major diameter (i.e., a diameter of the minimum circle surrounding the particle) of 5.0 μm or more are referred to as "coarse secondary phase particles". The coarse secondary phase particles are mainly formed of a Ni—Al based intermetallic compound, and therefore in the metallic structure having a large existing amount of the coarse secondary phase particles, Ni and Al, which are required for the precipitation of the fine secondary phase particles as an important factor in the present invention, are consumed in a large amount in the form of the coarse secondary phase particles. Consequently, in the case where the existing amount of the coarse secondary phase particles is large, it may be difficult to secure sufficiently the existing amount of the fine secondary phase particles. Furthermore, the coarse secondary phase particles may adversely affect the bending workability. As a result of the various investigations, on an observation plane in parallel to the sheet surface (rolled surface), the number density of coarse secondary phase particles having a major diameter of 5.0 μm or more is preferably suppressed to $5.0\times10^3$ per $mm^2$ or less. The number density of coarse secondary phase particles can be controlled to $5.0\times10^3$ per $mm^2$ or less by the production method described later, which is for providing a sheet material having a number density of the fine secondary phase particles of $1.0\times10^7$ per $mm^2$ or more in the aforementioned chemical composition range.

[Strength]

In consideration of the application to a conductive spring member demanded to have a reduced size, the tensile strength in the rolling direction is preferably 900 MPa or more. The tensile strength is more preferably 1,000 MPa or more, and the tensile strength may be controlled to 1,100 MPa or more. The excessive increase of the strength may increase the load in the cold rolling step, which may deteriorate the productivity, and may also be disadvantageous for retaining the good "strength-bending workability balance". The strength level is preferably controlled to provide a tensile strength in the rolling direction in a range of 1,300 MPa or less. The Vickers hardness of the sheet surface in terms of hardness number HV100 according to JIS Z2244:2009 is preferably 270HV or more, and more preferably 300HV or more. In consideration of the adverse effect of the excessive increase of the strength, the hardness may be controlled to a range of 400HV or less.

[Average Crystal Particle Diameter]

A small average crystal particle diameter in the sheet thickness direction in the cross section (C cross section) perpendicular to the rolling direction is also advantageous for achieving the good "strength-bending workability balance". Specifically, the average crystal particle diameter defined by the following (B) is preferably 50.0 μm or less.

(B) A straight line is randomly drawn in the sheet thickness direction on an optical micrograph obtained through observation of the cross section (C cross section) perpendicular to the rolling direction, and the average cut length of crystal particles cut by the straight line is designated as the average crystal particle diameter in the sheet thickness direction, provided that on one or plural observation view fields, plural straight lines that do not redundantly cut the same crystal particle are randomly set, and the total number of crystal particles that are cut by the plural straight lines is 100 or more.

[Production Method]

The copper alloy sheet material described above can be produced, for example, through the following production process.

Melting and casting->cast piece heating->hot rolling->cold rolling->(intermediate annealing->cold rolling)->solution treatment->(finish cold rolling)->first aging treatment->second aging treatment While not shown in the above process, facing may be performed depending on necessity after the hot rolling, and pickling, grinding, and further degreasing may be performed depending on necessity after each of the heat treatments. The steps will be described below.

[Melting and Casting]

A cast piece may be produced by continuous casting or semicontinuous casting.

[Cast Piece Heating]

The cast piece is heated and retained at 1,000 to 1,150° C. The heating operation may be performed by utilizing the cast piece heating step in hot rolling. The cast piece heating of a Cu—Ni—Al based copper alloy is generally performed at a temperature of 950° C. or less, and there has been no necessity of heating at a higher temperature for providing a high strength material having good characteristics. However, in the present invention, for achieving the good "strength-bending workability balance" in the compositional range with high contents of Ni and Al, it is necessary to secure the sufficient existing amount of the fine secondary phase particles. It is effective therefor that the cast piece is heated to the aforementioned temperature, so as to dissolve as much as possible the coarse secondary phase existing in the cast structure. At a temperature exceeding 1,150° C., the portion having a lower melting point in the cast structure becomes fragile to cause a possibility of cracking in hot rolling. The retention time of heating to the aforementioned temperature range is more effectively 2 hours or more. In consideration of the economical efficiently, the time of heating a case piece to the aforementioned temperature range is preferably set to a range of 5 hours or less.

[Hot Rolling]

In the hot rolling, it is important to secure a sufficient rolling reduction ratio at a temperature higher than the ordinary hot rolling temperature for a Cu—Ni—Al based copper alloy. Specifically, the rolling reduction ratio in a temperature range of 950° C. or more is set to 65% or more, and the rolling temperature in the final pass is set to 800° C. or more. The temperatures of the respective rolling passes each may be shown by the surface temperature of the material immediately after exiting from the work roll of the rolling pass. Assuming that the sheet thickness before the hot rolling is to (mm), and the sheet thickness obtained by the final rolling pass at a rolling temperature of 950° C. or more is $t_1$ (mm), the "rolling reduction ratio in a temperature range of 950° C. or more" is determined by substituting these values into the following expression (2).

$$\text{Rolling reduction ratio } (\%)=(t_0-t_1)/t_0\times 100 \quad (2)$$

The decomposition of the coarse Ni—Al based secondary phase derived from the cast structure is accelerated by securing the sufficient rolling reduction ratio at a high temperature according to the aforementioned condition, and the precipitation of the secondary phase in the cooling process after the hot rolling can be suppressed by setting the rolling temperature in the final pass to 800° C. or more. As a result, the secondary phase can be sufficiently dissolved even though the heating retention time in the solution treatment is relatively short. The total hot rolling reduction ratio may be, for example, 70 to 97%. After completing the hot rolling, the sheet material is preferably quenched by water cooling or the like.

[Cold Rolling]

Before the solution treatment, the sheet thickness is controlled by performing cold rolling. The process of "intermediate annealing->cold rolling" may be added once or multiple times as needed. The rolling reduction ratio in the cold rolling performed before the solution treatment (which is the rolling reduction ratio in the cold rolling after the final intermediate annealing in the case where the intermediate annealing is performed) may be, for example, 80% or more. The upper limit of the rolling reduction ratio maybe set, for example, to a range of 99.5% or less depending on the capability of the mill.

[Solution Treatment]

The solution treatment is performed mainly for dissolving sufficiently the Ni—Al based secondary phase (solutionization) before the aging treatment. In the present invention, the sheet material is heated at a temperature higher than the ordinary solution treatment temperature of a Cu—Ni—Al based copper alloy (approximately 800 to 900° C.). Specifically, the period of time where the material is retained in a temperature range of 950 to 1,100° C. is set to 30 to 360 seconds. The heating to the high temperature range can sufficiently dissolve the secondary phase even though the retention time is as short as described above. However, it is necessary to eliminate the coarse secondary phase in the cast structure by the aforementioned cast piece heating step. According to the studies by the present inventors, it has been found that in a Cu—Ni—Al based copper alloy having a chemical composition having high content of Ni and Al as targeted by the present invention, in the case where a sufficiently solutionized structure state is achieved, the precipitation of the second phase particles occurs inside the crystal particles even at a temperature of 700 to 900° C. overlapping the ordinary solution treatment temperature range of a Cu—Ni—Al based copper alloy (in the first aging treatment described later), and by utilizing the phenomenon, the existing amount of the fine secondary phase particles can be finally increased. Accordingly, the solution treatment at a high temperature of 950° C. or more is significantly effective for the enhancement of the "strength-bending workability balance" of the Cu—Ni—Al based copper alloy sheet material having the chemical composition targeted by the present invention.

In the case where the material temperature does not reach 950° C. or the case where the retention time at 950° C. is less than 30 seconds, it is difficult to utilize effectively the precipitation behavior in the first aging treatment, and the existing amount of the fine secondary phase particles cannot be controlled stably to the aforementioned target amount. The material temperature that exceeds 1,100° C. and the retention time at 950° C. or more that exceeds 360 seconds are not preferred since there is a possibility of coarsening the crystal particles.

In the case where the finish cold rolling is omitted after the solution treatment, the first aging treatment described later may be performed by the cooling process of the solution treatment, and in the case where the sheet material is cooled to around ordinary temperature after the solution treatment, the sheet material is preferably quenched, for example, to make an average cooling rate from 900° C. to 300° C. of 100° C./s or more.

[Finish Cold Rolling]

For the purpose of controlling the sheet thickness and imparting a lattice strain becoming a driving force of the aging precipitation, the sheet material may be subjected to the final cold rolling depending on necessity in the stage after the solution treatment. However, with a too large rolling reduction ratio in this cold rolling, the sites of nucleus generation of precipitate are significantly increased inside the crystal particles in the aging treatment, which tends to result in a structure state having a large proportion of ultrafine secondary phase particles, which cannot grow completely to the fine secondary phase particles. In this case, the bending workability may be deteriorated although the strength is increased. As a result of the various investigations, in the case where cold rolling is performed after the solution treatment, it is necessary to limit the rolling reduction ratio thereof to 50% or less, and more preferably to 40% or less. For sufficiently imparting the lattice strain, it is more effective to secure a rolling reduction ratio of 5% or more.

[First Aging Treatment]

The aging treatment is performed by the first aging treatment at a high temperature for a short period of time and the second aging treatment at a low temperature for a long period of time. In the first aging treatment, the period of time of retaining the material in a temperature range of 670 to 900° C. is set to 10 to 300 seconds. This temperature range overlaps the ordinary solution treatment temperature for a Cu—Ni—Al based copper alloy. However, since the present invention targets the Cu—Ni—Al based copper alloy having high contents of Ni and Al, and furthermore the structure state having been sufficiently solutionized at a high temperature as described above is retained in a temperature range of 670 to 900° C., a large amount of nuclei of the Ni—Al based secondary phase precipitate are formed inside the crystal particles. Furthermore, by retaining for the aforementioned period of time, such a structure state can be obtained that ultrafine secondary phase particles in the process of growing are dispersed in the crystal particles. As a result, in the second aging treatment, the precipitate having grown to the fine secondary particles is formed in a large amount inside the crystal particles, and the grain boundary reaction type discontinuous precipitate is suppressed from being formed, resulting in the progress of the precipitation of a fresh ultrafine secondary phase.

In the case where the retention temperature of the first aging treatment is lower than 670° C. or the case where the retention time at 670 to 900° C. is too short, the number of the precipitation sites is decreased, and it is difficult to secure sufficiently the existing amount of the fine secondary phase particles finally. In the case where the retention temperature of the first aging treatment exceeds 900° C., the precipitation itself is hard to occur to fail to provide the effect of the first aging treatment. In the case where the retention time at 670 to 900° C. is too long, the amount of the secondary phase particles having grown to a size exceeding a particle diameter of 100 nm is increased, and it is difficult to secure sufficiently the existing amount of the fine secondary phase particles of 20 to 100 nm finally. The first aging treatment is performed within a short period of time, and thus can be efficiently performed with a continuous annealing furnace in mass production sites.

[Second Aging Treatment]

The second aging treatment is performed subsequently. The second aging treatment grows the precipitate formed in the first aging treatment. The aging condition may be set to a range of 400 to 620° C. for 0.5 to 75 hours corresponding to the target strength level. In the case where the precipitate has been formed inside the crystal particles through the first aging treatment, the grain boundary reaction type discontinuous precipitate is hard to occur under the aforementioned aging condition, which is also advantageous for preventing the bending workability from being deteriorated.

In the case where the retention temperature of the second aging treatment is lower than 400° C. or the case where the retention time at 400 to 620° C. is too short, the growth of the precipitate formed in the first aging treatment becomes insufficient, and it is difficult to secure sufficiently the existing amount of the fine secondary phase particles. As a result, the enhancement of the bending workability becomes insufficient. Furthermore, a fresh precipitate inside the particles is also hard to occur, and the enhancement of the strength becomes insufficient due to the shortage of the existing amount of the ultrafine second phase particles. In the case where the temperature of the second aging treatment exceeds 620° C., the precipitate formed in the first aging treatment tends to grow to a size exceeding 100 nm, and also in this case, it is difficult to secure sufficiently the existing amount of the fine secondary phase particles.

The optimum aging treatment temperature may vary depending on the chemical composition of the copper alloy. Assuming that the maximum achieving temperature in the first aging treatment is $T_1$ (° C.), and the maximum achieving temperature in the second aging treatment is $T_2$ (° C.), it is more effective to set the conditions of the first aging treatment and the second aging treatment to make a difference between $T_1$ and $T_2$ of 150° C. or more. In the case where the first aging treatment is performed in the cooling process of the solution treatment, the maximum achieving temperature $T_1$ can be assumed to be 900° C.

The sheet material after completing the second aging treatment may be subjected to skin pass rolling or tension leveler for improving the surface property and the sheet shape as needed. However, it is preferred that cold rolling with a rolling reduction ratio of 10% or more and a heat treatment of heating to 250° C. or more (such as low temperature annealing) are not performed after the second aging treatment. These processing history and thermal history may prevent the excellent "strength-bending workability balance" from being stably achieved in some cases.

The sheet thickness of the sheet material according to the present invention thus obtained may be, for example, 0.03 to 0.50 mm. The sheet material may be used as a material for subjecting to a working process including press molding work and bending work, so as to provide a conductive spring member and the like.

EXAMPLES

Copper alloys having the chemical compositions shown in Table 1 were manufactured, and cast with a vertical semicontinuous casting machine. The resulting cast pieces were heated and retained at temperatures for periods of time shown in Tables 2A and 2E, then extracted, and subjected to hot rolling, followed by cooling with water. The total hot rolling reduction ratio was 90 to 95%, and the rolling reduction ratio in a temperature range of 950° C. or more, the rolling temperature of the final pass, and the finished sheet thickness after the hot rolling were values shown in Tables 2A and 2B. In some examples where cracks occurred in the hot rolling, the production was terminated at that point of time. After the hot rolling, the oxide layer as the surface layer was removed by mechanical grinding (facing), and the sheet materials were subjected to cold rolling with rolling reduction ratios shown in Tables 2A and 2B, so as to provide intermediate sheet materials for subjecting to a solution treatment. The intermediate sheet materials were subjected to a solution treatment under the conditions shown in Tables 2A and 2B with a continuous annealing furnace. The cooling after heating was performed with water. Except for an example (No. 11), the sheet materials were subjected to cold rolling with the rolling reduction ratios shown in Tables 2A and 2B after the solution treatment. Thereafter, the sheet materials were subjected to the first aging treatment at the temperatures shown in Tables 2A and 2B retaining for the periods of time shown in the same tables with a continuous annealing furnace. The maximum achieving temperature $T_1$ (° C.) in the first aging treatment was approximately the same as the retention temperature. The cooling after the first aging treatment was performed with water. Subsequently, the sheet materials were subjected to the second aging treatment at the temperatures shown in Tables 2A and 2B retaining for the periods of time shown in the same tables with a batch annealing furnace. The atmosphere at this time was air.

The maximum achieving temperature $T_2$ (° C.) in the second aging treatment was approximately the same as the retention temperature. The cooling after the second aging treatment was performed with air. According to the procedures, sheet material products (test materials) having the thicknesses shown in Tables 2A and 2B were provided.

The test materials were subjected to the following investigations.

(Number Density of Fine Secondary Phase Particles)

According to the "Method for obtaining Number Density of Fine Secondary Phase Particles" described above, the number density (per $mm^2$) of the fine secondary phase particles having a particle diameter $D_M$ of 20 to 100 nm was obtained through observation with an FE-SEM (JSM-7001, produced by JEOL, Ltd.).

For reference, the FE-SEM image obtained by observing the fine secondary phase particles of the sheet material obtained in Example 1 at a magnification of 150,000 is shown in FIG. 1.

(Number Density of Coarse Secondary Phase Particles)

According to the "Method for obtaining Number Density of Coarse Secondary Phase Particles" described above, the number density of the coarse secondary phase particles having a major diameter of 5.0 μm or more was obtained by observing with the FE-SEM the observation plane obtained by electrochemically polishing the sheet surface (rolled surface). The electrochemical polishing solution used for preparing the observation plane was a mixed liquid of distillated water, phosphoric acid, ethanol, and 2-propanol at a ratio of 10/5/5/1. The electrochemical polishing was performed with an electrochemical polishing apparatus (Electropolisher Power Supply, Electropolisher Cell Module), produced by Buehler Ltd., under condition of a liquid temperature of 20° C. and a voltage of 15 V for 20 seconds.

[Average Crystal Particle Diameter in Sheet Thickness Direction]

An observation plane obtained by etching the cross section (C cross section) perpendicular to the rolling direction to make the grain boundaries appear was observed with an FE-SEM, and the average crystal particle diameter in the sheet thickness direction defined by the (B) described above was obtained.

(Hardness)

The Vickers hardness of the sheet surface (HV100 in JIS Z2244:2009) was measured. Assuming the purpose of a conductive spring member having high strength, a specimen having 270HV or more was designated as pass.

(Tensile Strength)

A tensile test piece (JIS No. 5) in the rolling direction (LD) was collected from each of the test materials, and measured for the tensile strength by subjecting to a tensile test according to JIS 22241 with a number of specimens n=3. The average value of n=3 was designated as the evaluated value of the test material. In consideration of the purpose of a conductive spring member having high strength, a specimen having a tensile strength of 900 Pa or more was designated as pass.

(Bending Workability)

A 90° W-bending test with a bending axis in parallel to the rolling direction (BW) was performed by the method described in JIS H3110:2012. The ratio MBR/t of the minimum bending radius MBR that did not cause cracking and the sheet thickness t was obtained. Assuming the case where the sheet material in which the strength level of the Cu—Ni—Al based copper alloy having high contents of Ni and Al was increased as described above was processed into a conductive spring member, a specimen having MBR/t of 1.5 or less was evaluated as A (good bending workability), the other specimen was evaluated as B (insufficient bending workability), and the specimen with evaluation A was designated as pass.

(Discoloration Resistance)

A specimen of 10 mm in width×65 mm in length was collected from the test material, and the sheet surface (rolled surface) was dry polished with polishing paper #1200 (granularity: P1200 according to JIS R6010:2000) to prepare a weather resistance test piece. The weather resistance test was performed by exposing the test piece to an atmosphere of a temperature of 50° C. and a relative humidity of 95% for 24 hours. The surfaces of the test pieces before and after the weather resistance test were measured for L*a*b*, and the color difference $\Delta E^*_{ab}$ of L*a*b* color defined in JIS Z8730:2009 was obtained. A specimen having a color difference $\Delta E^*_{ab}$ of less than 5.0 can be judged as having good discoloration resistance as a conductive spring member. Accordingly, a specimen having a color difference $\Delta E^*_{ab}$, of less than 5.0 was evaluated as pass (good discoloration resistance). For reference, sheet materials of oxygen-free copper (C1020), 70-30 brass (C2600), and naval brass (C4622) were also subjected to the weather resistance test under the same condition. As a result, the color difference $\Delta E^*_{ab}$ was 11.0 for oxygen-free copper, 10.5 for 70-30 brass, and 10.7 for naval brass.

The evaluation results are shown in Tables 3A and 3B.

TABLE 1

| | | Chemical composition (% by mass) | | | | |
|---|---|---|---|---|---|---|
| Class | No. | Cu | Ni | Al | Others | Ni/Al |
| Inventive Example | 1 | balance | 20.1 | 2.98 | Mg: 0.07 | 6.7 |
| | 2 | balance | 20.6 | 2.48 | Co: 0.10 | 8.3 |
| | 3 | balance | 28.5 | 6.24 | Mg: 0.15 | 4.6 |
| | 4 | balance | 12.4 | 3.15 | Zn: 0.80, Zr: 0.03 | 3.9 |
| | 5 | balance | 27.5 | 4.27 | Co: 0.16, P: 0.02 | 6.4 |
| | 6 | balance | 18.6 | 2.13 | B: 0.005, Fe: 0.16 | 8.7 |
| | 7 | balance | 15.0 | 2.00 | Ti: 0.08, Si: 0.12 | 7.5 |
| | 8 | balance | 21.1 | 5.00 | Mn: 0.14, Cr: 0.10 | 4.2 |
| | 9 | balance | 19.5 | 1.95 | Sn: 0.36, Ti: 0.12 | 10.0 |
| | 10 | balance | 29.0 | 6.07 | Mg: 0.18 | 4.8 |
| | 11 | balance | 20.1 | 2.77 | Zn: 0.30, Sn: 0.15 | 7.3 |
| | 12 | balance | 20.5 | 3.05 | — | 6.7 |
| Comparative Example | 31 | balance | 20.0 | 3.01 | Mg: 0.16 | 6.6 |
| | 32 | balance | 18.6 | 2.12 | Mg: 0.14 | 8.8 |
| | 33 | balance | 18.6 | 3.05 | Mg: 0.15 | 6.1 |
| | 34 | balance | 18.6 | 3.06 | Sn: 0.15, Zn: 0.80, Zr: 0.03 | 6.1 |
| | 35 | balance | 18.6 | 3.18 | Mg: 0.15 | 5.8 |
| | 36 | balance | 31.5 | 4.20 | — | 7.5 |
| | 37 | balance | 10.5 | 1.97 | — | 5.3 |
| | 38 | balance | 23.0 | 6.75 | — | 3.4 |
| | 39 | balance | 18.1 | 1.52 | — | 11.9 |
| | 40 | balance | 27.6 | 2.53 | — | 10.9 |
| | 41 | balance | 13.1 | 2.05 | Mg: 0.08 | 6.4 |
| | 42 | balance | 16.5 | 1.95 | — | 8.5 |
| | 43 | balance | 20.1 | 2.71 | — | 7.4 |
| | 44 | balance | 20.4 | 3.94 | — | 5.2 |
| | 45 | balance | 20.6 | 3.51 | — | 5.9 |
| | 46 | balance | 21.7 | 4.12 | — | 5.3 |
| | 47 | balance | 20.0 | 2.02 | — | 9.9 |
| | 48 | balance | 21.5 | 3.00 | — | 7.2 |
| | 49 | balance | 23.5 | 3.42 | Mg: 0.15 | 6.9 |

Underline: outside the scope of invention

TABLE 2A

| Class | No. | Cast piece heating: Temperature (° C.) | Cast piece heating: Time (h) | Hot rolling: ≥950° C. rolling reduction ratio (%) | Hot rolling: Final pass temperature (° C.) | Hot rolling: Finish sheet thickness (mm) | Cold rolling Rolling reduction ratio (%) | Solution treatment: Temperature (° C.) | Solution treatment: Time (s) | Finish cold rolling Rolling reduction ratio (%) | First aging treatment: Temperature (° C.) | First aging treatment: Time (s) | Second aging treatment: Temperature (° C.) | Second aging treatment: Time (h) | Sheet thickness (mm) |
|---|---|---|---|---|---|---|---|---|---|---|---|---|---|---|---|
| Inventive Example | 1 | 1100 | 3 | 80.4 | 850 | 11.5 | 99.0 | 1000 | 60 | 16.7 | 800 | 60 | 500 | 10 | 0.10 |
| | 2 | 1050 | 3 | 71.5 | 845 | 7.4 | 98.4 | 1000 | 300 | 16.7 | 800 | 150 | 500 | 10 | 0.10 |
| | 3 | 1050 | 3 | 80.4 | 902 | 11.5 | 99.0 | 1075 | 60 | 16.7 | 800 | 60 | 500 | 10 | 0.10 |
| | 4 | 1125 | 3 | 79.5 | 895 | 14.5 | 99.2 | 1000 | 60 | 16.7 | 800 | 60 | 500 | 40 | 0.10 |
| | 5 | 1050 | 3 | 71.5 | 841 | 11.5 | 99.0 | 1000 | 40 | 16.7 | 800 | 60 | 450 | 10 | 0.10 |
| | 6 | 1050 | 3 | 71.5 | 851 | 11.5 | 99.0 | 1000 | 60 | 5.2 | 850 | 60 | 500 | 10 | 0.11 |
| | 7 | 1050 | 3 | 71.5 | 825 | 11.5 | 99.0 | 1000 | 60 | 15.3 | 800 | 20 | 500 | 10 | 0.10 |
| | 8 | 1050 | 3 | 71.5 | 853 | 7.4 | 94.6 | 1000 | 60 | 37.5 | 800 | 60 | 500 | 10 | 0.25 |
| | 9 | 1050 | 3 | 71.5 | 846 | 11.5 | 99.0 | 975 | 60 | 15.3 | 800 | 60 | 600 | 10 | 0.10 |
| | 10 | 1050 | 3 | 80.4 | 904 | 11.5 | 99.0 | 1000 | 60 | 15.3 | 700 | 60 | 500 | 10 | 0.10 |
| | 11 | 1050 | 3 | 71.5 | 859 | 11.5 | 99.1 | 1000 | 60 | 0 | 800 | 60 | 500 | 10 | 0.10 |
| | 12 | 1050 | 3 | 80.4 | 892 | 7.4 | 98.5 | 1000 | 60 | 9.9 | 800 | 60 | 500 | 1 | 0.10 |

TABLE 2B

| Class | No. | Cast piece heating: Temperature (° C.) | Cast piece heating: Time (h) | Hot rolling: ≥950° C. rolling reduction ratio (%) | Hot rolling: Final pass temperature (° C.) | Hot rolling: Finish sheet thickness (mm) | Cold rolling Rolling reduction ratio (%) | Solution treatment: Temperature (° C.) | Solution treatment: Time (s) | Finish cold rolling Rolling reduction ratio (%) | First aging treatment: Temperature (° C.) | First aging treatment: Time (s) | Second aging treatment: Temperature (° C.) | Second aging treatment: Time (h) | Sheet thickness (mm) |
|---|---|---|---|---|---|---|---|---|---|---|---|---|---|---|---|
| Comparative Example | 31 | 950 | 3 | 7.5 | 851 | 11.5 | 95.8 | 1000 | 60 | 15.3 | 800 | 60 | 500 | 10 | 0.10 |
| | 32 | 1100 | 3 | 80.4 | 903 | 11.5 | 95.8 | 925 | 60 | 15.3 | 800 | 60 | 500 | 10 | 0.10 |
| | 33 | 1175 | 3 | 86.6 | (terminated due to cracks occurring in hot rolling) | | | | | | | | | | — |
| | 34 | 1050 | 1 | 71.5 | 846 | 11.5 | 95.8 | 1125 | 60 | 15.3 | 800 | 60 | 500 | 10 | 0.10 |
| | 35 | 1050 | 3 | 71.5 | 770 | 11.5 | 95.8 | 1000 | 600 | 15.3 | 800 | 60 | 500 | 10 | 0.10 |
| | 36 | 1050 | 3 | 71.5 | (terminated due to cracks occurring in hot rolling) | | | | | | | | | | — |
| | 37 | 1100 | 3 | 80.4 | 847 | 11.5 | 95.8 | 1000 | 60 | 16.7 | 800 | 60 | 500 | 10 | 0.10 |
| | 38 | 1050 | 3 | 71.5 | (terminated due to cracks occurring in hot rolling) | | | | | | | | | | — |
| | 39 | 1050 | 3 | 71.5 | 855 | 11.5 | 95.8 | 1000 | 60 | 16.7 | 800 | 60 | 500 | 10 | 0.10 |
| | 40 | 1100 | 3 | 80.4 | 905 | 11.5 | 95.8 | 1000 | 15 | 16.7 | 800 | 60 | 500 | 10 | 0.10 |
| | 41 | 1100 | 3 | 80.4 | 901 | 11.5 | 95.8 | 1000 | 60 | 60 | 800 | 60 | 500 | 10 | 0.10 |
| | 42 | 1050 | 3 | 58.0 | 848 | 11.5 | 95.8 | 1000 | 60 | 16.7 | 800 | 60 | 500 | 10 | 0.10 |
| | 43 | 1050 | 3 | 71.5 | 850 | 11.5 | 95.8 | 1000 | 60 | 16.7 | 950 | 60 | 500 | 10 | 0.10 |
| | 44 | 1050 | 3 | 71.5 | 850 | 11.5 | 95.8 | 1000 | 60 | 15.3 | 800 | 60 | 700 | 10 | 0.10 |
| | 45 | 1100 | 3 | 71.5 | 843 | 11.5 | 95.8 | 1000 | 60 | 15.3 | 600 | 60 | 500 | 10 | 0.10 |
| | 46 | 1050 | 3 | 71.5 | 854 | 11.5 | 95.8 | 1000 | 60 | 15.3 | 800 | 60 | 350 | 10 | 0.10 |
| | 47 | 1050 | 3 | 71.5 | 853 | 11.5 | 95.8 | 1000 | 60 | 15.3 | 800 | 800 | 500 | 10 | 0.10 |
| | 48 | 1050 | 3 | 71.5 | 850 | 11.5 | 95.8 | 1000 | 60 | 15.3 | 800 | 5 | 500 | 10 | 0.10 |
| | 49 | 1050 | 3 | 71.5 | 847 | 11.5 | 95.8 | 1000 | 60 | 15.3 | 800 | 60 | 500 | 0.05 | 0.10 |

Underline: outside the scope of invention

TABLE 3A

| Class | No. | Number density of fine secondary phase particles ($\times 10^7$ per /mm$^2$) | Number density of coarse secondary phase particles ($\times 10^3$ per mm$^2$) | Average crystal particle diameter in sheet thickness direction (μm) | Hardness (HV) | Tensile strength in roiling direction (MPa) | Evaluation of bending workability | Color difference before and after weather resistance test ΔE'ab |
|---|---|---|---|---|---|---|---|---|
| Inventive Example | 1 | 26.9 | 0.0 | 11.5 | 355 | 1172 | A | 4.0 |
| | 2 | 20.2 | 0.0 | 20.2 | 340 | 1122 | A | 4.0 |
| | 3 | 33.9 | 0.0 | 29.9 | 370 | 1221 | A | 3.0 |
| | 4 | 18.5 | 0.0 | 11.5 | 360 | 1188 | A | 4.3 |
| | 5 | 27.4 | 1.1 | 10.0 | 340 | 1122 | A | 3.2 |

TABLE 3A-continued

| Class | No. | Number density of fine secondary phase particles ($\times 10^7$ per /mm$^2$) | Number density of coarse secondary phase particles ($\times 10^3$ per mm$^2$) | Average crystal particle diameter in sheet thickness direction (μm) | Hardness (HV) | Tensile strength in roiling direction (MPa) | Evaluation of bending workability | Color difference before and after weather resistance test ΔE'ab |
|---|---|---|---|---|---|---|---|---|
| | 6 | 2.5 | 1.1 | 33.1 | 310 | 1023 | A | 4.2 |
| | 7 | 10.5 | 0.0 | 13.1 | 320 | 1056 | A | 4.6 |
| | 8 | 33.3 | 0.0 | 3.4 | 365 | 1205 | A | 3.7 |
| | 9 | 3.6 | 2.2 | 8.8 | 315 | 1040 | A | 3.5 |
| | 10 | 18.3 | 0.0 | 13.1 | 355 | 1172 | A | 3.0 |
| | 11 | 9.7 | 0.0 | 45.7 | 315 | 1040 | A | 4.0 |
| | 12 | 15.6 | 0.0 | 25.2 | 340 | 1122 | A | 3.9 |

TABLE 3B

| Class | No. | Number density of fine secondary phase particles ($\times 10^7$ per /mm$^2$) | Number density of coarse secondary phase particles ($\times 10^3$ per mm$^2$) | Average crystal particle diameter in sheet thickness direction (μm) | Hardness (HV) | Tensile strength in roiling direction (MPa) | Evaluation of bending workability | Color difference before and after weather resistance test ΔE'ab |
|---|---|---|---|---|---|---|---|---|
| Comparative Example | 31 | 0.0 | 20.5 | 13.1 | 350 | 1155 | B | 4.0 |
| | 32 | 0.0 | 13.0 | 3.2 | 335 | 1106 | B | 4.2 |
| | 33 | — | — | — | — | — | — | — |
| | 34 | 0.0 | 18.5 | 56.3 | 310 | 1023 | B | 4.1 |
| | 35 | 0.0 | 16.0 | 29.4 | 320 | 1056 | B | 4.1 |
| | 36 | — | — | — | — | — | — | — |
| | 37 | 16.8 | 0.0 | 11.5 | 315 | 1040 | A | 7.7 |
| | 38 | — | — | — | — | — | — | — |
| | 39 | 0.2 | 0.0 | 11.5 | 250 | 825 | B | 5.4 |
| | 40 | 0.0 | 5.5 | 7.1 | 358 | 1181 | B | 3.4 |
| | 41 | 0.4 | 0.0 | 1.7 | 390 | 1287 | B | 4.8 |
| | 42 | 0.0 | 14.2 | 9.6 | 335 | 1106 | B | 4.5 |
| | 43 | 0.4 | 0.0 | 12.5 | 350 | 1155 | B | 4.0 |
| | 44 | 0.2 | 0.0 | 15.3 | 320 | 1056 | B | 3.9 |
| | 45 | 0.2 | 0.0 | 12.0 | 354 | 1168 | B | 3.9 |
| | 46 | 0.4 | 0.0 | 12.6 | 231 | 762 | B | 3.7 |
| | 47 | 0.2 | 0.0 | 13.7 | 334 | 1102 | B | 4.1 |
| | 48 | 0.4 | 0.0 | 13.1 | 342 | 1129 | B | 3.8 |
| | 49 | 0.2 | 0.0 | 15.9 | 239 | 789 | B | 3.6 |

Underline: outside the scope of invention
Crosshatched: insufficient property

All the Cu—Ni—Al based copper alloy sheet materials of the inventive examples had excellent "strength-bending workability balance" and excellent discoloration resistance.

On the other hand, in No. 31 as a comparative example, the coarse Ni—Al based secondary phase in the cast structure was insufficiently decomposed due to the low cast piece heating temperature and the low hot rolling reduction ratio at 950° C. or more associated thereto, resulting in a metal structure having a large residual amount of the coarse secondary phase particles. As a result, the number density of fine secondary phase particles was not sufficiently secured, resulting in poor bending workability.

In No. 32, the dissipation (solutionization) of the secondary phase was insufficient due to the low solution treatment temperature, resulting in a metal structure having a large residual amount of the coarse secondary phase particles. As a result, the number density of fine secondary phase particles was not sufficiently secured, resulting in poor bending workability.

In No. 33, cracks occurred in a fragile portion close to the melting point in hot rolling due to the too high cast piece heating temperature, which prevented the execution of the subsequent process, and the experiment was terminated.

In No. 34, the decomposition of the coarse Ni—Al based secondary phase in the cast structure became insufficient due to the short cast piece heating time, and the dissipation (solutionization) of the secondary phase was difficult even though the solution temperature was as high as 1,125° C. As a result, the residual amount of the coarse secondary phase particles was large and the number density of fine secondary phase particles was not sufficiently secured, resulting in poor bending workability.

No. 35 was an example where the final pass temperature of hot rolling was low, and the period of time of the solution treatment was long. In this case also, the residual amount of the coarse secondary phase particles was large, and the number density of fine secondary phase particles was not sufficiently secured, resulting in poor bending workability.

No. 36 was an example with a high Ni content of the alloy, and No. 38 was an example with a high Al content of the alloy. In both the examples, cracks occurred in hot rolling due to the poor hot workability, which prevented the execution of the subsequent process, and the experiment was terminated.

No. 37 was inferior in discoloration resistance due to the low Ni content of the alloy.

No. 39 was an example with a low Al content of the alloy. In this case, the Al amount for sufficiently securing the amount of the Ni—Al based precipitate formed was short, and the existing amount of the fine secondary phase particle was small, resulting in poor bending workability.

Furthermore, it was considered that the amount of the ultrafine secondary phase particles precipitated was also small, and the strength level was low. Moreover, the discoloration resistance was poor.

In No. 40, the dissipation (solutionization) of the secondary phase was insufficient due to the short solution treatment time, resulting in a metal structure having a large residual amount of the coarse secondary phase particles. As a result, the number density of fine secondary phase particles was not sufficiently secured, resulting in poor bending workability.

In No. 41, the amount of the sites of nucleus generation of the precipitate became significantly large in the crystal particles in the aging treatment due to the too high cold rolling reduction ratio after the solution treatment, resulting in a metal structure having a large proportion of the ultrafine secondary phase particles that did not grow completely to the fine secondary phase particles. In this case, the existing amount of the fine secondary phase particles was small, resulting in poor bending workability, although the high strength level was obtained.

In No. 42, the decomposition of the coarse Ni—Al based secondary phase in the cast structure was insufficient due to the low hot rolling reduction ratio at 950° C. or more, resulting in a metal structure having a large residual amount of the coarse secondary phase particles. As a result, the number density of fine secondary phase particles was not sufficiently secured, resulting in poor bending workability.

In No. 43, the precipitation in the first aging treatment was not sufficiently performed due to the high temperature in the first aging treatment. In this case, the effect of the first aging treatment was not obtained, and the existing amount of the fine secondary phase particles was small, resulting in poor bending workability.

In No. 44, a large proportion of the precipitate formed in the first aging treatment grew to a size exceeding 100 nm in the second aging treatment due to the high secondary aging treatment temperature, resulting in the small existing amount of the fine secondary phase particles. As a result, the bending workability was poor.

In No. 45, the number of the precipitation sites was decreased due to the low temperature in the first aging step, and finally the existing amount of the fine secondary phase particles was not sufficiently secured. As a result, the bending workability was poor.

In No. 46, it was considered that the amount of the ultrafine secondary phase particles precipitated was small due to the low temperature in the second aging step, and the strength level was low. Furthermore, the growth to the fine secondary phase particles became insufficient, and the existing amount of the fine secondary phase particles was small, resulting in poor bending workability.

In No. 47, the amount of secondary phase particles that grew to a size exceeding 100 nm was large due to the long period of time of the first aging treatment, and the existing amount of the fine secondary phase particles of 20 to 100 nm was not sufficiently secured. As a result, the bending workability was poor.

In No. 48, the precipitation in the first aging treatment did not sufficiently proceed due to the short period of time of the first aging treatment. In this case, the existing amount of the fine secondary phase particles was decreased due to the insufficient effect of the first aging treatment, resulting in poor bending workability.

In No. 49, it was considered that the amount of precipitation of the ultrafine secondary phase particles was small due to the short period of time of the second aging treatment, and the strength level was low. Furthermore, the growth to the fine secondary phase particles was insufficient, and the existing amount of the fine secondary phase particles was small, resulting in poor bending workability.

The invention claimed is:

1. A copper alloy sheet material having a composition containing, in terms of % by mass, Ni: more than 12.0% and 30.0% or less, Al: 1.80-6.50%, Mg: 0-0.30%, Cr: 0-0.20%, Co: 0-0.30%, P: 0-0.10%, B: 0-0.05%, Mn: 0-0.20%, Sn: 0-0.40%, Ti: 0-0.50%, Zr: 0-0.20%, Si: 0-0.50%, Fe: 0-0.30%, and Zn: 0-1.00%, with the balance of Cu and unavoidable impurities, and satisfying the following expression (1), and having a metallic structure having, on an observation plane in parallel to a sheet surface, a number density of fine secondary phase particles having a particle diameter $D_M$ defined by the following (A) of 20 to 100 nm of $1.0\times10^7$ per $mm^2$ or more:

$$Ni/Al \leq 15.0 \quad (1)$$

wherein in the expression (1), the atomic symbols are substituted by the contents of the elements expressed with % by mass, (A) assuming that for one secondary phase particle, a diameter (nm) of a minimum circle surrounding the particle is referred to as a "major diameter", and a diameter (nm) of a maximum circle encompassed in a contour of the particle is referred to as a "minor diameter", a value shown by (major diameter+minor diameter)/2 is designated as the particle diameter $D_M$ of the particle.

2. The copper alloy sheet material according to claim 1, wherein an average crystal particle diameter in a sheet thickness direction defined by the following (B) is 50.0 μm or less, (B) a straight line is randomly drawn in the sheet thickness direction on an optical micrograph obtained through observation of a cross section (C cross section) perpendicular to a rolling direction, and an average cut length of crystal particles cut by the straight line is designated as the average crystal particle diameter in the sheet thickness direction, provided that on one or plural observation view fields, plural straight lines that do not redundantly cut the same crystal particle are randomly set, and the total number of crystal particles that are cut by the plural straight lines is 100 or more.

3. The copper alloy sheet material according to claim 1, wherein, on an observation plane in parallel to a sheet surface (rolled surface), a number density of coarse secondary phase particles having a major diameter is 5.0 μm or more of 5.0×10 3 per $mm^2$ or less.

4. The copper alloy sheet material according to claim 1, wherein the copper alloy sheet material has a tensile strength in the rolling direction of 900 MPa or more.

5. A method for producing a copper alloy sheet material, comprising:

a step of heating a cast piece having a composition containing, in terms of % by mass, Ni: more than 12.0% and 30.0% or less, Al: 1.80-6.50%, Mg:

0-0.30%, Cr: 0-0.20%, Co: 0-0.30%, P: 0-0.10%, B: 0-0.05%, Mn: 0-0.20%, Sn: 0-0.40%, Ti: 0-0.50%, Zr: 0-0.20%, Si: 0-0.50%, Fe: 0-0.30%, and Zn: 0-1.00%, with the balance of Cu and unavoidable impurities, and satisfying the following expression (1), to 1,000 to 1,150° C. (cast piece heating step);

a step of subjecting to hot rolling under a condition providing a rolling reduction ratio at 950° C. or more of 65% or more and a rolling temperature in a final pass of 800° C. or more (hot rolling step);

a step of subjecting to cold rolling at a rolling reduction ratio of 80% or more (cold rolling step);

a step of subjecting to a heat treatment at 950 to 1,100° C. retaining for 30 to 360 seconds (solution treatment step);

a step of subjecting to cold rolling in a range of a rolling reduction ratio of 50% or less (finish cold rolling step);

a step of subjecting to a heat treatment at 670 to 900° C. retaining for 10 to 300 seconds (first aging treatment); and a step of subjecting to a heat treatment at 400 to 620° C. retaining for 0.5 to 75 hours (second aging treatment), performed in this order, so as to provide a metallic structure having, on an observation plane in parallel to a sheet surface, a number density of fine secondary phase particles having a particle diameter $D_M$ defined by the following (A) of 20 to 100 nm of 1.0×10 7 per $mm^2$ or more:

$$Ni/Al \leq 15.0 \quad (1)$$

wherein in the expression (1), the atomic symbols are substituted by the contents of the elements expressed with % by mass, (A) assuming that for one secondary phase particle, a diameter (nm) of a minimum circle surrounding the particle is referred to as a "major diameter", and a diameter (nm) of a maximum circle encompassed in a contour of the particle is referred to as a "minor diameter", a value shown by (major diameter+minor diameter)/2 is designated as the particle diameter $D_M$ of the particle.

6. A method for producing a copper alloy sheet material comprising the production method according to claim 5, provided that the finish cold rolling step is not performed, and a material obtained by the solution treatment is subjected to the first aging treatment.

7. A conductive spring member comprising the copper alloy sheet material according to claim 1 as a material.

* * * * *